United States Patent [19]

Takeuchi

[11] Patent Number: 4,657,369

[45] Date of Patent: Apr. 14, 1987

[54] DISPOSABLE PHOTOCONDUCTIVE BELT ASSEMBLY FOR A PRINTER OR A COPIER

[75] Inventor: Shoji Takeuchi, Allendale, N.J.

[73] Assignee: Kentek Information Systems, Inc., Allendale, N.J.

[21] Appl. No.: 718,947

[22] Filed: Apr. 2, 1985

[51] Int. Cl.[4] ..... G03G 15/00

[52] U.S. Cl. ..... 355/3 BE; 355/3 DD; 355/3 R

[58] Field of Search ..... 355/14 C, 3 BE, 3 DD, 355/3 R, 3 CH

[56] References Cited

U.S. PATENT DOCUMENTS

| | | | |
|---|---|---|---|
| 3,976,375 | 8/1976 | Kurita et al. | 355/14 R |
| 4,291,341 | 9/1981 | Yajima | 355/14 C |
| 4,416,532 | 11/1983 | Rosati | 355/3 BE |
| 4,470,689 | 9/1984 | Nomura et al. | 355/3 R |
| 4,556,308 | 12/1985 | Hoppner et al. | 355/3 R |

OTHER PUBLICATIONS

Xerox Disclosure Journal "Combination Belt Sensor and Grounding Device" vol. 10, No. 2, Mar./Apr. 1985, p. 77.

*Primary Examiner*—Arthur T. Grimley
*Assistant Examiner*—David S. Warren
*Attorney, Agent, or Firm*—Marmorek, Guttman & Rubenstein

[57] ABSTRACT

A self-contained photoconductive belt assembly for a printer or a copier is disclosed. The self-contained photoconductive belt assembly is in the form of a cartridge or cassette, comprising a frame, first and second parallel rollers within the frame, and an endless photoconductive belt looped about and rotating with the rollers. The cassette also includes a charging unit and mounting means for detachably mounting the cassette within the printer or cassette. Desirably, the cassette also contains a photosensor for detecting the seam in the photoconductive belt. Desirably also, the cassette is slidably mounted within the housing of the printer or copier in a vertical orientation.

15 Claims, 2 Drawing Figures

DISPOSABLE PHOTOCONDUCTIVE BELT ASSEMBLY FOR A PRINTER OR A COPIER

BACKGROUND OF THE INVENTION

The present invention relates to a disposable photoconductive belt assembly. More particularly, the present invention relates to a disposable cartridge having a closed-loop, flexible, photoconductive belt therein. Such a cartridge finds use in printing and copying machines.

Generally, in the process of electrophotographic or xerographic printing, a photoconductive member, such as a drum, is charged to a substantially uniform potential to sensitize its surface. In the case of a copying machine, the charged portion of the photoconductive surface is exposed to a light image of an original document being reproduced. This records an electrostatic latent image on the photoconductive member corresponding to the informational areas contained within the original document. In the case of a printing machine connected to a computer, the charged portion of the photoconductive surface is exposed to a light image, the shape of which is controlled by input signals from the computer. Here too, an electrostatic latent image corresponding to informational areas is recorded on the photoconductive member.

After recording the electrostatic latent image on the photoconductive member, the latent image is developed by bringing a developer material or toner into contact therewith. The developer material is attracted to the electrostatic latent image to form a powder image which is subsequently transferred to a sheet. Thereafter, the powder image is permanently affixed to the sheet in image configuration.

It is generally recognized that the cost of a printing or copying machine may be significantly reduced by implementing the concept of disposable components. Thus, it is highly desirable to be able to use relatively inexpensive components within the printing or copying machine and, after the expiration of their useful lives, to replace these components. In order to be economically competitive, these components must be easily and readily replaceable by the machine operator.

In keeping with this concept, flexible, closed-loop photoconductive belts have been used for a number of years in xerographic printing and copying machines. These photoconductive belts have several advantages over the bulky drums having photoconductive surfaces which are also used in printing and copying machines. The primary advantage of such belts is that they are relatively inexpensive and easy to replace. Thus, after a large number of uses, a drum must be either replaced or cleaned. Replacing the drum is expensive while cleaning the drum is a tedious, time-consuming chore.

To overcome these difficulties, some prior art devices employ disposable photoconductive sheets or webs mounted on the drums. However, such configurations are not popular because of difficulties in proper attachment and alignment of the sheets for correct xerographic operation. Closed-loop belts mounted on rollers are more desirable because the belts are manufactured to predetermined tolerances. In addition, the assemblies containing the belt can be fitted into the machines so as to locate the belts properly relative to the other machine components within the printing or copying machines.

Several closed-loop, photoconductive belt mechanisms are described in the prior art. U.S. Pat. No. 4,403,851 (Yanagawa) discloses a compact electrostatic copying machine having an endless photoconductive belt looped about a pair of rollers. In this copying machine, the belt assembly is attached to a cover on the top of the housing of the machine. The cover is hinged to the housing and may be opened and closed. Thus, the belt assembly moves with the cover. Also, no simple means are disclosed in this patent for detaching and replacing the photoconductive belt assembly from the cover.

U.S. Pat. No. 4,416,532 (Rosati) discloses another photoconductive belt arrangement for a copying machine. This arrangement includes many machine parts including a latch assembly and a tensioning assembly. When the tensioning assembly is deactivated, the photoconductive belt can be removed from the capstans and replaced.

U.S. Pat. No. 4,470,690 (Hoffman) discloses yet another copying machine incorporating a photoconductive belt arrangement. In this apparatus, the photoconductive belt is looped about two rollers of different sizes. The photoconductive belt assembly is disposed generally horizontally within the copier in order to take advantage of an arcuate paper injection magazine. In this patent, the belt assembly is disclosed as being removable as a self-contained unit. However, the photoconductive belt assembly includes many parts including a tensioning assembly. The tensioning assembly is used for releasing and then reapplying the tension on the belt so that it can be removed from the rollers and replaced.

It is an object of the present invention to provide a photoconductive belt assembly for a xerographic printing or copying machine which can be easily removed and replaced as a self-contained unit.

It is another object of the present invention to provide a self-contained photoconductive belt assembly which has relatively few parts and is inexpensive to manufacture.

It is a further object of the present invention to provide a self-contained photoconductive belt assembly which does not require a tensioning assembly for removing and replacing the photoconductive belt.

It is a further object of the present invention to provide a self-contained photoconductive assembly having a charging unit and a photosensor attached thereto so that they may be easily removed and replaced along with the photoconductive belt.

SUMMARY OF THE INVENTION

These and other objects are accomplished by means of the present invention which in one of its embodiments comprises a self-contained photoconductive belt assembly in the form of a cartridge or a cassette for an electrographic printing or copying machine. The self-contained photoconductive belt assembly of the present invention comprises a frame, first and second parallel rollers rotatably mounted within the frame, and an endless photoconductive belt looped about and rotating with the rollers. The self-contained photoconductive belt assembly of the present invention also includes a charging unit mounted on the frame and mounting means on the frame for detachably mounting the photoconductive belt assembly within the electrographic printing or copying machine. Desirably, the cartridge is slidably mounted and vertically positioned in the housing. As a result, the self-contained photoconductive belt assembly of the present invention can be easily removed and replaced as a unit.

In another embodiment, the present invention comprises an electrographic printing or copying machine for forming an image on a sheet of paper. The printing apparatus comprises a housing, sheet transport means, the novel self-contained photoconductive belt assembly previously described, imaging means for forming an image on the photoconductive belt in response to a signal, developing means for developing the image on the photoconductive belt to produce a toner image, transfer means for transferring the toner image to the sheet, and drive means for rotating the rollers about which the photoconductive belt is looped.

In a preferred embodiment, the self-contained photoconductive belt assembly of the present invention also includes a charging unit for the photoconductive belt and a photosensor. The purpose of the photosensor is to detect the seam in the photoconductive belt. The imaging and the sheet transport means can then be coordinated with the signals generated by the photosensor to ensure that the electrostatic latent image does not cross the seam on the photoconductive belt.

In an especially preferred embodiment, the self-contained photoconductive belt assembly of the present invention is detachably mounted within a so-called "smart" printing or copying machine. Such machines contain internal computers which control and coordinate the various units within the machines. The internal computers also receive signals from and detect the status of each of the various units within the machines. Thus, the internal computer within such a machine can receive signals from the photosensor within the self-contained photoconductive belt assembly, and can synchronize the imaging unit and sheet transport means in response thereto.

DETAILED DESCRIPTION OF THE INVENTION

Figure 1:
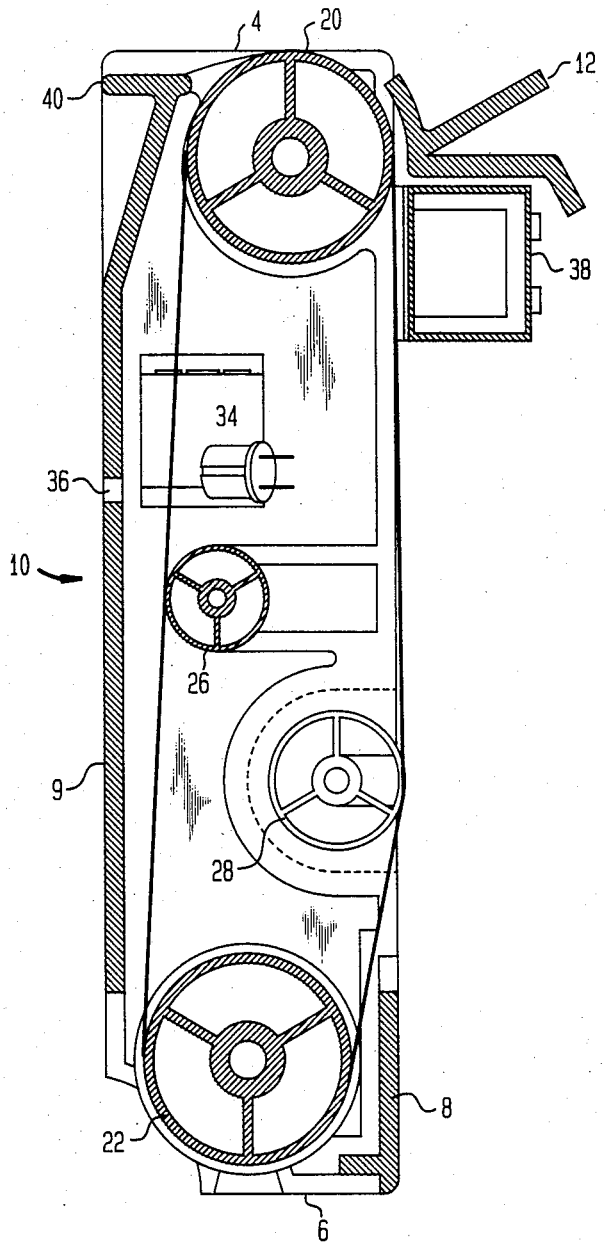
FIG. 1 is a cross-sectional view of the self-contained photoconductive belt assembly.

Referring to the drawings, one particular embodiment of the photoconductive belt assembly is illustrated. The photoconductive belt assembly illustrated is designed to be inserted into a printing apparatus, such as a printer or a copier, having an internal computer.

As shown, the photoconductive belt assembly is in the form of a cassette or a cartridge 10. Cassette 10 has a frame comprising a top 4, a bottom 6, a front wall 8, a back wall 9 and sidewalls 2. Front wall 8 does not extend along the full height of cassette 10. A handle 12 is attached to the frame of cassette 10. Desirably, handle 12 is pivotally attached to sidewalls 2. The handle aids in removing and carrying cassette 10. The pivoting feature also enables the user to tuck the handle 12 away after cassette 10 has been inserted into the printing apparatus.

Rollers 20 and 22 are also pivotally mounted to sidewalls 2 by means of shafts (not shown). A bearing cap 24 for roller 20 can be seen in FIG. 2. Rollers 20 and 22 are mounted in a manner so that they can rotate freely about their axis, roller 22 being the drive roller and roller 20 being the driven roller. Additional rollers 26 and 28 are also mounted to sidewalls 2 by means of shafts 46 and 50 and also rotate freely. Roller 28 is also supported by bearing cap 48. These additional rollers 26 and 28 serve as idler rollers. They also help to keep the imaging position on photoconductive belt 30 fixed.

Photoconductive belt 30 is disposed about all of the aforesaid rollers. The outer surface of belt 30 is coated with zinc oxide or a similar photoconductive material. Such materials are well known to those skilled in the art.

As those skilled in the art are aware, a seam (not shown) runs across belt 30. This seam presents a discontinuity in the photoconductive surface. As discussed previously, it is desirable that the imaging means and the paper feed means be synchronized with the rotation of belt 30. For this purpose, a photosensor 34 is disposed within cassette 10. A small notch (not shown) is located at the edge of belt 30 at a predetermined distance from the seam in the belt. An aperture 36 is provided in back wall 9 near its edge. A lamp (not shown) aligns with aperture 36 and photosensor 34. However, photosensor 34 is not activated, so long as belt 30 blocks the light from reaching photosensor 34. When the notch in photoconductive belt 30 also aligns with the lamp, aperture 36, and photosensor 34, the light reaches photosensor 34 and the circuit is closed. This information is conveyed to the on-board computer of the printing machine which can then synchronize the various stations so that the latent image is not projected across the seam of belt 30.

In the illustrated embodiment, a charging unit 38 is mounted onto the frame of cassette 10 below handle 12. The charging unit sensitizes the photoconductive belt in response to a signal from the internal computer. When the handle 12 is folded downward, after insertion of cassette 10 into the printing machine, the handle tucks over charging unit 38. Since the charging unit is mounted directly onto cassette 10, it will normally be replaced along with the remainder of cassette 10.

A paper guide 40 is formed integrally with back wall 9. Paper from the paper supply means reaches paper guide 40 and is directed into contact with belt 30 directly above roller 20. At that point the latent image is transferred to the paper and the paper is transported to the other stations.

Figure 2:
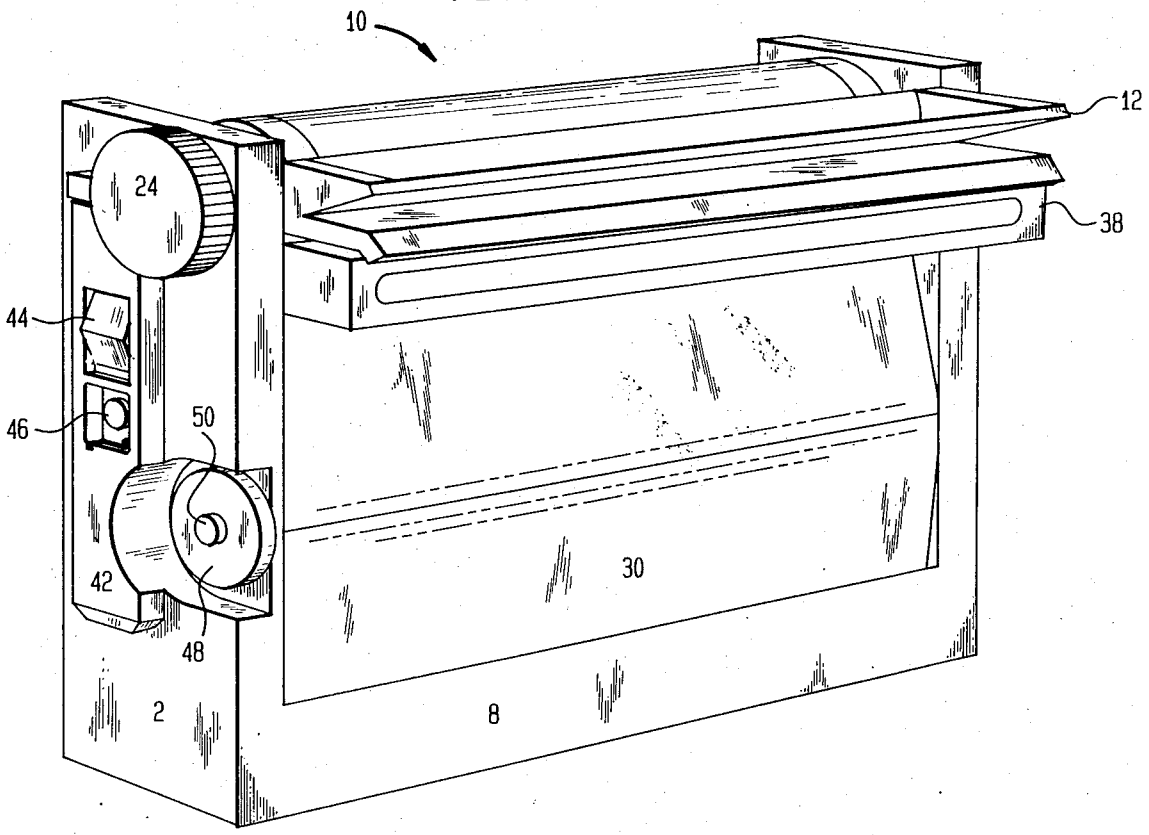
FIG. 2 is a perspective view of one particular embodiment of the self-contained photoconductive belt assembly of the present invention.

Referring to FIG. 2, guide shoes 42 are mounted on sidewalls 2 of cassette 10. Guide shoes 42 are designed to mate with corresponding keyed slots (not shown) inside the housing of the printing apparatus. Leaf springs 44 are also provided in guide shoes 42 and project therefrom. When the cassette 10 is inserted into the housing of the printing machine, leaf springs 44 snap into place in the keyed slots. Stops (not shown) at the bottom of the keyed slots are located in the housing to ensure that cassette 10 is properly in place. Electrical connectors (not shown) are also provided in one of the sidewalls 2 so that cassette 10 can communicate with and be controlled by the internal computer. Such electrical connectors are well known to those skilled in the art.

In operation, cassette 10 is inserted vertically into the housing of the printer or copier. Guide shoes 42 slide into the keyed slots of the housing while leaf springs 44 snap into place. The cassette 10 slides downward until it meets the stops at the bottom of the keyed slots.

When being used, the paper is transported along paper guide 40 until it is in contact with photoconductive belt 30 directly above roller 20. The latent image on photoconductive belt 30 is transferred directly to the underside of the paper. From there, the paper is transported to the various other stations in the machine where the image is developed and fixed to the paper.

When the useful life of the photoconductive belt has expired, cassette 10 is simply lifted out of the housing by means of handle 12 and replaced. Thus, belt 30 as well as photosensor 34 and charging unit 38 are replaced in one simple operation. No longer is it necessary to clean these units. It should also be recognized that no tensioning assembly is required in the cassette of the present invention. The belt need not ever be removed from the rollers. Instead, the entire cassette is replaced when the useful life of the belt has expired. Thus, the tension of the belt can be set at the factory to manufacturer's specifications and need not be readjusted.

While the invention has been described by reference to particular embodiments, this was for purposes of illustration only and should not be construed to limit the spirit or scope of the invention.

What is claimed is:

1. A self-contained photoconductive belt assembly for an electrographic printing apparatus, comprising a frame, first and second substantialy parallel rollers rotatably mounted within said frame, said first and second rollers being aligned vertically within said frame, an endless photoconductive belt disposed about and rotating with said first and second rollers, charging means mounted on said frame for charging said photoconductive belt, mounting means for slidably and removably mounting said self-contained photoconductive belt assembly vertically within said electrographic printing apparatus, and sheet guide means mounted integrally on the top of said frame, said sheet guide means and frame defining a horizontal transfer zone for said electrographic printing apparatus on top of said frame,

2. The photoconductive belt assembly of claim 1 wherein said electrographic printing apparatus is a printer connected to a computer.

3. The photoconductive belt assembly of claim 1 wherein said electrographic printing apparatus is a copier.

4. The photoconductive belt assembly of claim 1 wherein said electrographic printing apparatus has a controller.

5. The photoconductive belt assembly of claim 1 further comprising sensing means for detecting a seam in said photoconductive belt.

6. The photoconductive belt assembly of claim 1 wherein said belt disposed about said first and second parallel rollers has a predetermined tension.

7. The photoconductive belt assembly of claim 1 wherein said mounting means comprises snap lock means.

8. An electrographic printing apparatus for forming an image on a sheet of a recording medium, comprising a housing, sheet transport means for feeding the sheet and transporting it through said housing, a self-contained photoconductive belt assembly, said self-contained photoconductive belt assembly comprising a frame, first and second substantially parallel rollers rotatably mounted within said frame, said first and second rollers being aligned vertically within said frame, an endless photoconductive belt disposed about and rotating with said first and second rollers, charging means mounted on said frame for charging said photoconductive belt, mounting means for slidably mounting said self-contained photoconductive belt assembly vertically within said housing, and sheet guide means mounted integrally on the top of said frame, said sheet guide means and frame defining a horizontal transfer zone on top of said frame, said self-contained belt assembly being removable vertically from said electrographic printing apparatus as a unit, imaging means for forming an image on said photoconductive belt, developing means for developing said image to produce a toner image, transfer means for transferring said toner image to said sheet, and drive means for rotating said first and second rollers and thereby said photoconductive belt.

9. The electrographic printing apparatus of claim 8 comprising a printer connected to a computer.

10. The electrographic printing apparatus of claim 8 comprising a copier.

11. The electrographic printing apparatus of claim 8 further comprising a controller to control the operation of said apparatus.

12. The electrographic printing apparatus of claim 8 wherein said recording medium is paper.

13. The electrographic printing apparatus of claim 8 wherein said belt assembly further comprises sensing means for detecting a seam in said photoconductive belt.

14. The electrographic printing apparatus of claim 8 wherein the tension on said photoconductive belt is predetermined.

15. The electrographic printing apparatus of claim 8 wherein said mounting means comprising snap lock means.

* * * * *